US005954841A

United States Patent [19]

Beven

[11] Patent Number: 5,954,841

[45] Date of Patent: Sep. 21, 1999

[54] WOOL SCOURING

[75] Inventor: Peter William Beven, Hamilton, Australia

[73] Assignee: Primary Applications Limited, Goulbourn NSE, Australia

[21] Appl. No.: 09/116,035

[22] Filed: Jul. 15, 1998

Related U.S. Application Data

[63] Continuation of application No. PCT/AU97/00019, Jan. 15, 1997.

[30] Foreign Application Priority Data

Jan. 16, 1996 [AU] Australia ..... PN7582
Jul. 11, 1996 [AU] Australia ..... PO0963

[51] Int. Cl.[6] ..... D01B 3/06; D01B 3/08; D06M 10/00; D06M 10/06

[52] U.S. Cl. ..... 8/139; 8/137; 8/115.52; 8/147; 8/148; 8/156; 68/3 R; 68/901; 134/1; 134/105; 134/133; 134/184; 134/201; 210/748; 210/263; 162/151; 19/200

[58] Field of Search ..... 8/139, 137, 115.52, 8/147, 148, 156; 68/901, 355, 3 R; 134/1, 105, 133, 184, 201; 210/748, 263; 162/151; 19/200

[56] References Cited

U.S. PATENT DOCUMENTS 1,449,613 3/1923 McBride ..... 19/65 R
1,449,826 3/1923 McBride ..... 162/151

FOREIGN PATENT DOCUMENTS

11862/33 7/1934 Australia .
399599 11/1933 United Kingdom .
641678 8/1950 United Kingdom .
WO 94/16126 7/1994 WIPO .

OTHER PUBLICATIONS

Robertson et al., "Dry Scouring Greasy Wool to Reduce Water Pollution," Textile Chemist and Colorist, vol. 5, pp. 98–101, May 1973.

Textile Chemist and Colorist vol. 5, pp. 98–101; GH Robertson and JP Morgan, May 1973 "Dry Scouring Greasy Wool to Reduce Water Pollution".

*Primary Examiner*—Alan Diamond
*Attorney, Agent, or Firm*—McDonnell Boehnen Hulbert & Berghoff

[57] ABSTRACT

The present invention provides an improved method for scouring wool. The method comprises differential heating of grease contaminants in the unscoured wool to at least partially liquefy the grease, absorbing the grease by the addition of a grease-absorbing material, and separating the grease-absorbing material from the wool. The method of the invention involves substantially less water consumption than current methods and is a more efficient means of producing wool.

14 Claims, 3 Drawing Sheets

WOOL SCOURING

This application is a continuation of international patent application PCT/AU 97/00019, filed Jan. 15, 1997, which claims priority to Australian patent application PN 7582 filed Jan. 16, 1996, and PO 0963 filed Jul. 11, 1996, all of which are incorporated by reference in their entirety.

TECHNICAL FIELD

The present invention relates to an improved process for scouring wool and apparatus to carry out wool scouring.

BACKGROUND ART

Wool is one of the most important animal fibres used in textile manufacture. Wool is considered superior to other fibres because of its outstanding natural properties of feel, moisture absorption, strength and its ability to hang. Before wool can be used in textile manufacture or for other uses, it must undergo a number of treatment processes.

Raw wool from sheep and other animals contains many constituents considered contaminants by wool processors and the contaminants must be substantially removed from the wool prior to use. The type and amount of contaminants can vary according to breed, nutrition, environment and position of the wool on the animal. The main contaminants are a solvent-soluble fraction called wool grease, protein material, a water-soluble fraction (largely perspiration salts collectively termed suint), dirt and vegetable matter in the form of burrs and seeds from pastures. A fleece may contain up to 30% by weight of contaminants, depending on the animal, so it is important that the wool is treated before use.

The first process of preparing wool involves the removal of the contaminants and this process is termed scouring.

In traditional wool scouring, the contaminants on the wool, mainly grease, dirt, suint and protein material are washed from the wool fibre using water and detergents. The contaminants remain in the waste water either in emulsion or suspension (grease, dirt, protein) or in solution (suint). Extraction of the waste water produces grease contaminated with detergent and suint and is termed wool grease. The traditional methods of wool scouring involve extensive processing, the addition of detergents, and the use of large amounts of water. Typical scouring plants can consume up to half a million litres of water per day. Apart from the requirement of a large amount of water, there is a problem of disposing of the waste water without unduly contaminating the environment. The problem of disposal involves further expense and, with stricter environmental emission controls, requires some form of treatment prior to release into the environment.

Other contaminants present in raw wool include herbicides and pesticides which often require specific treatment to remove them from waste water produced in conventional scouring. Any increased costs of scouring wool are usually passed on to the consumer and therefore result in an increase in the price of wool in relation to other competing fibres, including man-made fibres, used in the same industries.

The present inventor has developed a method for scouring wool that requires substantially less water consumption than present methods and involves an efficient means of producing clean wool.

DISCLOSURE OF INVENTION

In a first aspect the present invention consists in a process for scouring wool comprising the steps of:

(a) treating the wool so as to cause at least partial liquefaction of grease contaminants present in the wool;

(b) adding to the wool a material capable of absorbing liquefied grease contaminants in wool, steps (a) and (b) can be carried out in any order;

(c) mixing the wool and the grease-absorbing material such that a desired amount of the liquefied grease contaminants absorb to the material; and (d) separating the grease-absorbed material from the wool.

In a second aspect, the present invention consists in an apparatus for scouring wool comprising:

(a) a treating means to cause at least partial liquefaction of grease contaminants present in the wool;

(b) a vessel adapted to receive wool and a material capable of absorbing liquefied grease contaminants present in wool;

(c) means for mixing the wool and grease-absorbing material in the vessel, and (d) means for separating the grease-absorbed material from the wool, wherein the treating means causes at least partial liquefaction of the grease contaminants when the wool is in the vessel, and the wool and the grease-absorbing material are mixed in the vessel by the mixing means such that a desired amount of the liquefied-grease contaminants absorb to the material prior to separation.

Preferably, the treating involves heating the wool. More preferably, the treating involves differential heating such that the grease contaminants are heated while the wool fibres and the grease-absorbing material are substantially unheated or at least heated less than the grease contaminants.

Liquefaction of the grease contaminants occurs around 50–60° C. In order reduce the possibility of causing damage to the wool fibres, the temperature of the wool fibres during scouring should preferably not exceed about 70° C. In order to obtain the differential heating, the treating step preferably involves heating by irradiation with microwave energy. It will be appreciated that any other treatment that causes the grease contaminants to at least partially liquefy while not substantially heating the wool or the grease-absorbing material to the same temperature of the grease contaminants could also be used for the present invention.

Treating the wool and mixing the wool with the grease-absorbing material are preferably carried out in the one vessel. This assists in the control of the scouring process and ensures that the wool and the grease-absorbing are mixed sufficiently to allow the liquefied grease to come in contact with the grease-absorbing material and be removed from the wool. Any vessel that can induce mixing of the wool and grease-absorbing material would be suitable. Examples of suitable vessels include cyclone chambers, rotary drums and augers.

It will be appreciated that the grease-absorbing material can be added before or during the treating step. The scouring process may be carried out in batch or in a continuous manner depending on the apparatus being used to carry out the process.

The grease-absorbing material is preferably a particulate material. A particulate material particularly suitable for the present invention is diatomaceous earth. Other materials which absorb grease, however, would also be suitable for use in the present invention. Examples of such materials include talc powder, silicon dioxide, hydroxylapatite, silica gel and other particulate matter capable of absorbing grease and oils. As diatomaceous earth is known for its ability to absorb water, it would be appreciated that other hygroscopic materials may also absorb grease, fats and oils present in wool and therefore may be suitable for the present invention.

The amount of grease-absorbing material added to the wool varies depending on the degree of contamination of the wool and the extent of scouring required. Furthermore, the ratio of grease-absorbing material to wool would depend on the grease-absorbing capacity of the material used and the type and degree of contamination of the wool to be scoured. The quality and quantity of grease and other contaminants in the wool would also influence the amount of grease-absorbing material required. It will be appreciated that different types of wool may also require different amounts of grease-absorbing material.

Upon liquefaction of the grease contaminants, the mixing of the grease-absorbing material with the wool results in the grease contaminants absorbing to the material and therefore being removed from the wool fibres. It would also be appreciated that some of the other contaminants present in the wool, for example dirt and vegetable matter, will also be associated with the liquefied grease and be removed from the fibres by the present invention.

One advantage of the present invention is that there is no requirement for the addition of significant amounts of water during the scouring process. It will be appreciated, however, that there will be moisture associated with the wool.

The process of the present invention is adaptable so that the extent of removal of the grease contaminants from the wool can be manipulated. In order that the scoured wool may be treated efficiently for textile use, a small proportion of grease is usually retained in the wool in order to assist handling. The present invention allows the control of the amount of grease removed from wool by manipulating the degree of treatment, the amount of grease-absorbing material used during scouring, and the extent of mixing.

The present process and apparatus for wool scouring is suitable for all forms of wool and not limited to wool produced by sheep. For example, wool from alpacas, goats and the like could also be scoured with the method and apparatus of the present invention.

It will be expected that the degree of contamination of wool, in particular from sheep, varies greatly according to the breed of animal and the environment in which the animal is raised. In Australia, wool from sheep raised in Queensland often contains less grease contaminants but more dust and dirt compared to sheep raised, for example, in the cooler climates in southern Australia. Furthermore, lambs wool has a much lower percent of contaminants than wool from adult sheep and therefore requires less treatment to be scoured appropriately. The present method can be controlled so as ensure optimum scouring of different wools. When the treating means includes microwave radiation, the degree of irradiation can be changed in proportion to the amount of grease contaminants in the wool. By including monitors within the apparatus of the present invention, continual feedback on the degree of removal of the grease contaminants can be obtained. It will be appreciated that microprocessor and computer control can be applied to the apparatus such that the degree of scouring required can be monitored and adjusted accordingly.

The apparatus of the present invention can be used in isolation or several units may be coupled in series so that gradual scouring is achieved as the wool passes to each successive apparatus. The scoured wool may be treated subsequently, for example washed, to remove remaining dirt and other particulate matter, and the wool processed further in the usual manner.

The grease-absorbed material may be processed further such that the grease is removed and the material can be re-used. The grease removed from the wool may be processed further to produce lanolin in the usual manner.

The use of microwave energy to heat the wool utilises the fact that compounds with different dielectric constants absorb microwave energy differently. Materials with high dielectric constants absorb microwaves preferentially and therefore are heated before materials with lower dielectric constants. As grease contaminants in wool have high dielectric constants, they preferentially absorb microwaves and are heated while wool and the grease-absorbing material, which have lower dielectric constants, absorb microwaves substantially less than the grease and therefore are not heated to the same degree.

The microwave frequency used in the present invention is in the order of 2.45 GHz. This frequency is the one available for use in Australia but other frequencies may also be used in the present invention. For a wool scouring plant treating about 4 tonne of wool grease per day using the apparatus of the present invention would require approximately 100 kW of energy per hour. One advantage of the use of microwave technology is the amount of energy needed can be adjusted up to about 520 kW using microwave generators presently available.

In a third aspect, the present invention consists in wool scoured by the process according to the first aspect of the present invention.

In order that the present invention may be more clearly understood, forms will be described with reference to the drawings.

MODES FOR CARRYING OUT THE INVENTION

Figure 1:
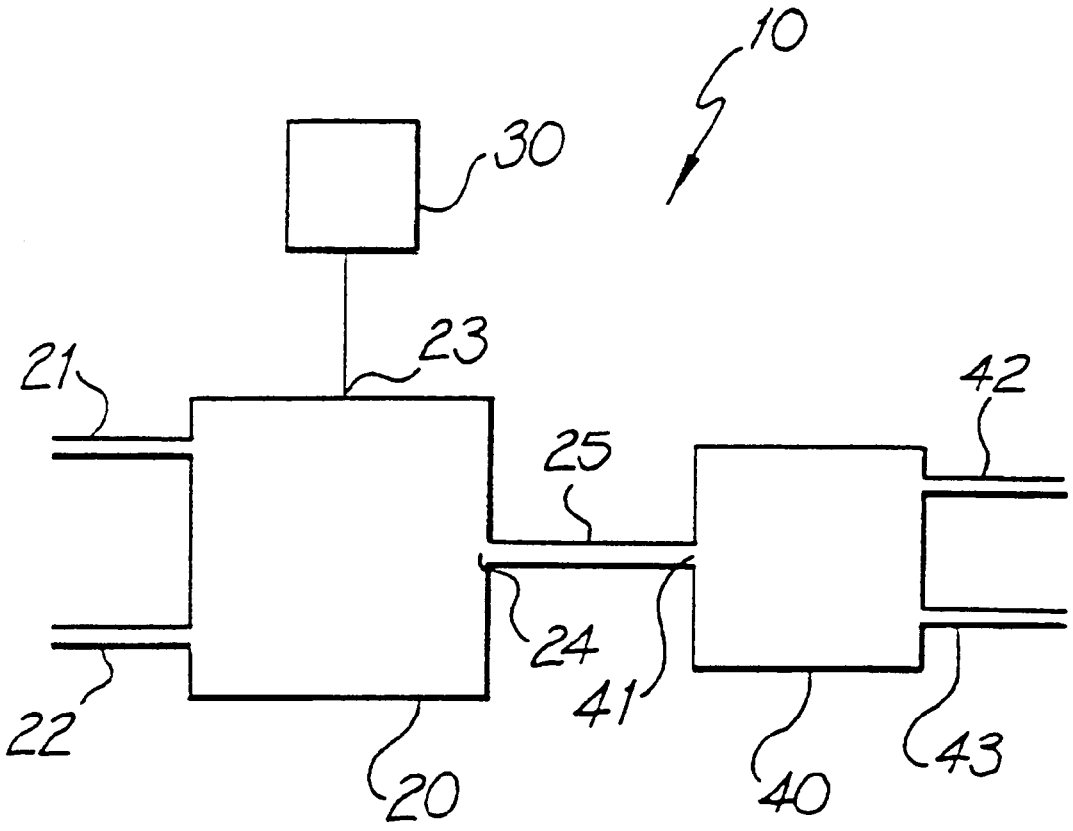
FIG. 1 is a schematic of an apparatus including a rotating drum and a de-duster for scouring wool according to the present invention.

As indicated in FIG. 1, the wool scouring apparatus 10 of this embodiment comprises a rotating drum 20, a microwave energy source 30 and a de-dusting machine 40. The drum 20 is provided with inlets 21 and 22 at one end through which wool and a grease-absorbing material can be added.

The drum 20 is also provided with an inlet port 23 through which microwave radiation is transmitted from the microwave energy source 30.

After treatment, the wool and grease-absorbing material exit the drum 20 via port 24 along passage 25 through to port 41 of the de-dusting machine 40 where the scoured wool is separated from the grease-absorbed material. The scoured wool exits through port 42 and the grease-absorbed material exits through port 43.

In use, unscoured raw ("greasy") wool is fed into the drum 20 through port 21. The grease-absorbing material in the form of diatomaceous earth is fed into the drum 20 through port 22. Typically, the wool and diatomaceous earth are conveyed pneumatically through their respective inlet ports 21 and 22.

Microwave radiation is transmitted into the drum 20 through port 23. The wool and diatomaceous earth are mixed by rotation of the drum 20 while being subjected to the microwave radiation. This microwave energy is absorbed by the grease contaminants in the wool, thereby heating the grease and causing at least some of it to liquefy. The diatomaceous earth absorbs the liquid grease as the two come in contact while being mixed within the drum 20. Other contaminants, including dirt and suint, associated with the grease may also absorb to the grease-absorbing material and also be removed by the scouring process. Once the wool and diatomaceous earth have been mixed for a period of time such that the required amount of grease is removed from the wool to the diatomaceous earth, the mixture is fed from the drum 20 via port 24 to the de-dusting machine 40 through port 41. The scoured wool is then separated from the grease-absorbed diatomaceous earth through a combination of mechanical and air movement and removed through port 42.

The grease-absorbed diatomaceous earth is removed via port 43 of the de-dusting machine 40. If required, the grease-absorbed diatomaceous earth is optionally conveyed to a reprocessing plant where the diatomaceous earth and the wool grease are separated. This may be through a combination of microwave energy exposure and chemical washing. The "cleaned" diatomaceous earth may then be reused for further scouring.

The amount of irradiation can be adjusted according to the volume of wool to be scoured and the degree of contaminants in the wool. Furthernore, the amount of grease-absorbing material may also be adjusted depending on the amount of grease present in the wool and the degree of scouring required. The scouring process can be monitored in situ and the volume of wool, amount of irradiation and amount of grease-absorbing material changed in order to optimise the scouring process.

Although the embodiment described above utilises an apparatus to separate the scoured wool from the grease-absorbed material, it will be appreciated that the whole process can be carried out in the one apparatus. Furthermore, any means that will allow the removal of the scoured wool from the grease-absorbed material would be suitable. Such methods would include cyclone separation, washing, willowing, shaking, filtering and spinning.

Figure 2:
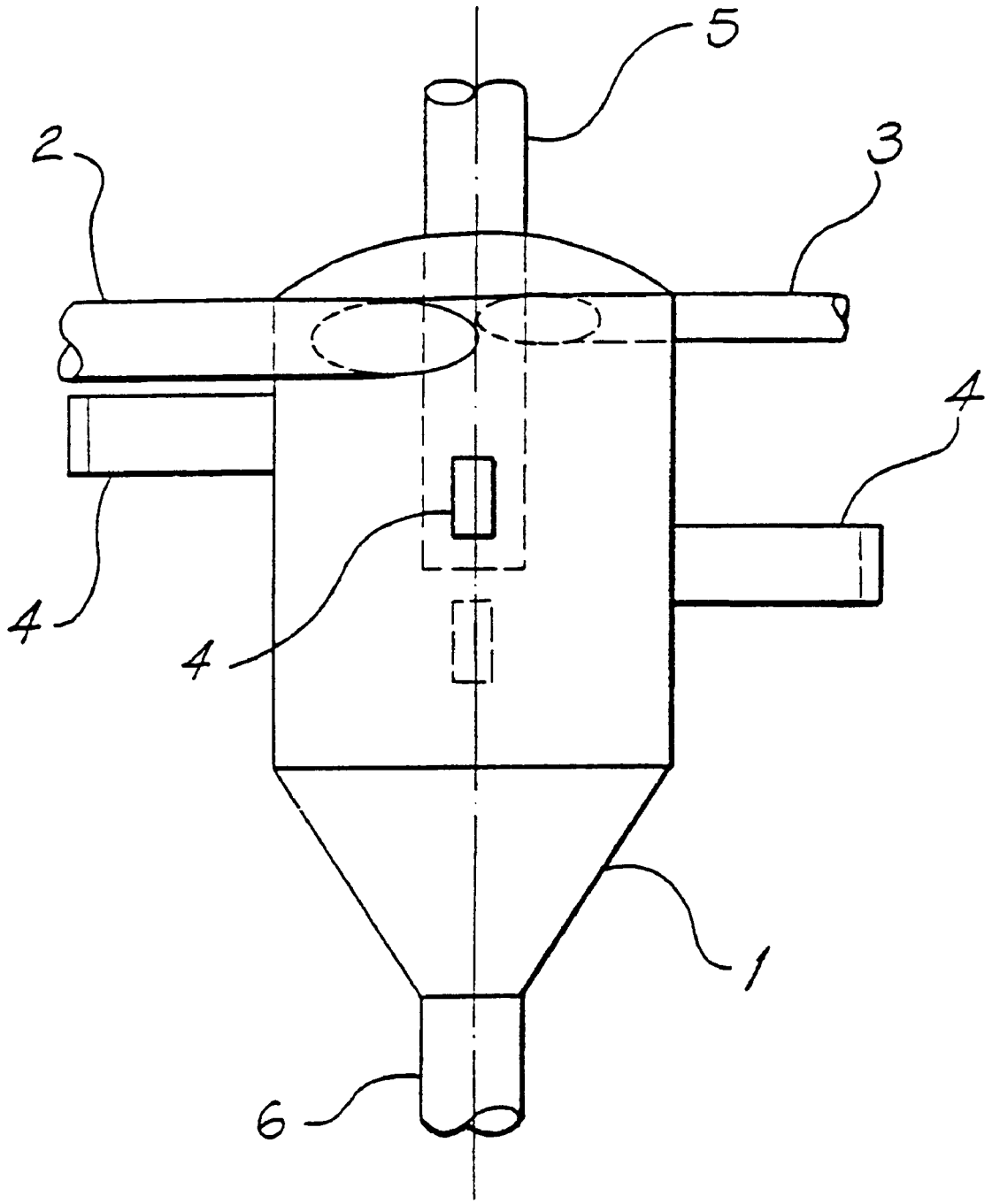
FIG. 2 is a schematic side elevation of an embodiment of a cyclone that can be used for scouring wool.
Figure 3:
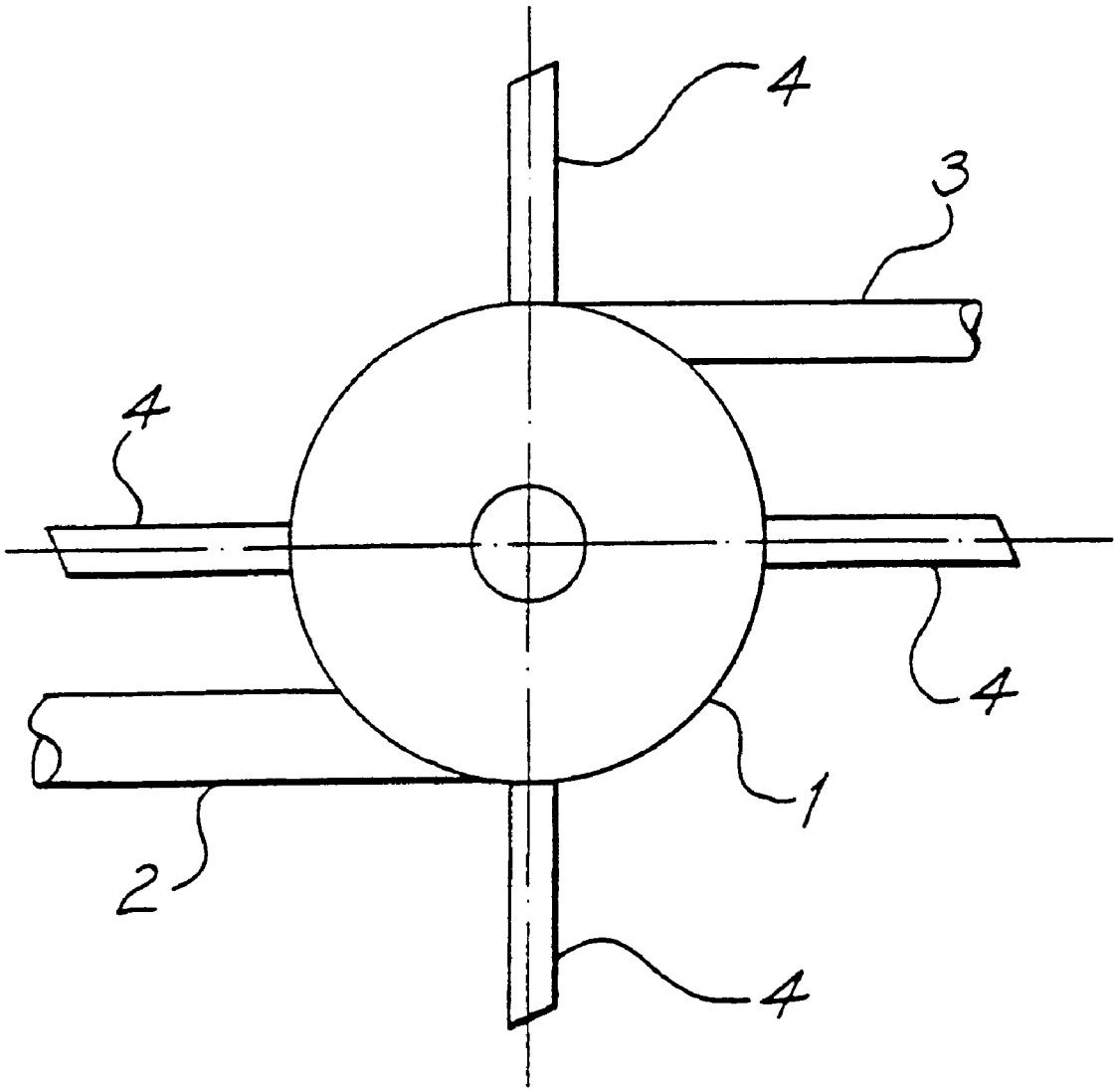
FIG. 3 is a schematic plan view of the cyclone of FIG. 2.

As shown in FIGS. 2 and 3, the wool scouring apparatus of this embodiment comprises a cyclone 1 having a cyclone chamber defined by a cylindrical housing mounted on top of an inverted frustro-conical section. The chamber is provided with inlet ports 2, 3 through which material may be added into the chamber.

The chamber is also provided with inlet ports 4 through which microwave radiation is transmitted into the chamber. Typically, inlet ports 4 are waveguides connected to the cyclone 1. The microwave ports 4 are suitably spaced equi-angularly around the cyclone housing 1, and at vertically spaced locations, as shown more clearly in FIG. 3. Microwave transparent window screens are suitably provided between the cyclone chamber and the ports 4, to prevent material from entering the ports 4 from the cyclone chamber.

Outlet ports 5, 6 are provided respectively at the top and bottom of the cyclone 1.

In use, unscoured raw ("greasy") wool is fed into the cyclone 1 through port 2. At the same time, a grease-absorbing material (such as diatomaceous earth) is fed into the cyclone chamber through port 3. Typically, the wool and diatomaceous earth are conveyed pneumatically through their respective inlet ports.

Microwave radiation is transmitted into the cyclone chamber 1 through ports 4.

The wool and diatomaceous earth are mixed by the action of the turbulent flow created inside the cyclone chamber 1, while being subjected to the microwave energy. This microwave energy is absorbed by the grease contaminants, thereby heating the grease and causing it to become liquid. The diatomaceous earth absorbs the liquid grease as the two come in contact while being mixed within the cyclone chamber. Other contaminants, including dirt and suint, associated with the grease may also absorb to the grease absorbing material.

As a result of such absorption of the liquefied wool grease, the density or weight of the diatomaceous earth increases, causing it to migrate to the bottom of the cyclone chamber as it can no longer be supported by the turbulent air flow. The grease-containing diatomaceous earth is then removed from the outlet port 6 of the cyclone 1 by a metering device (such as a rotary feeder or valve) and/or pneumatic conveyor.

Conversely, the density or weight of the wool decreases as the grease is removed therefrom, and hence the clean wool migrates to the top of the cyclone 1 where it is removed through outlet port 5 by a metering device and/or pneumatic conveyor.

The grease-absorbed diatomaceous earth removed from the cavity is suitably conveyed to a reprocessing chamber where the two elements, namely the diatomaceous earth and the wool grease, are separated, e.g. through a combination of microwave exposure and chemical washing. The "cleaned" diatomaceous earth may then be reused for further scouring.

The amount of irradiation can be adjusted according to the volume of wool to be scoured and the content of contaminants in the wool. Furthermore, the amount of grease-absorbing material may also be adjusted depending on the amount of grease present in the wool and the degree of scouring required. The scouring process can be monitored in situ and the volume of wool, amount of irradiation, and amount of grease absorbing material changed in order to optimise the process.

In order to test the efficiency of the process according to the present invention, experiments were carried out in an apparatus as previously described with reference to FIG. 1 comprising a rotating drum and a de-dusting machine. Two kilograms of greasy wool (comprising about 25% per weight wool grease) were treated by different variations of the process as shown in Table 1. Diatomaceous earth was used as the grease-absorbing material and was mixed with the wool in the ratios (wt/wt) as described. In order to test whether an additional washing/extraction step was of use to improve the scouring process, a water or 1,1,2-Trichloroethane solvent rinse was also incorporated in some of the tests. Residual ash is defined as grease-absorbing material, vegetable matter and any other particulate material present during scouring. The temperature indicated is the temperature to which the grease contaminants were heated with microwave irradiation in the rotating drum.

Table 1 shows the results of tests carried out on wool scoured according to several variations of the process of the present invention. As can be seen from the results, the process allows substantial removal of grease and other contaminants from wool.

The present invention provides a fast and economical method of scouring wool. Moreover, the wool is scoured in a substantially "dry"process which leaves minimal waste products and is environmentally acceptable.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

TABLE 1

| Sample Test | Temperature (° C.) | Grease-Absorbing Material/ Wool Ratio | Water Rinse | Solvent Rinse | Ash Removal | Residual Grease (%) | Residual Ash (%) |
|---|---|---|---|---|---|---|---|
| 1 | 58 | 1:1 | N | N | A | 5.60 | 14.89 |
| 2 | 58 | 1:1 | N | N | A | 5.89 | 12.58 |
| 3 | 58 | 1:1 | N | N | B | 3.87 | 10.58 |
| 4 | 58 | 1:1 | N | N | B | 3.68 | 10.20 |
| 5 | 58 | 1:2 | N | N | C | 2.67 | 5.87 |
| 6 | 58 | 1:2 | N | N | C | 2.69 | 5.99 |
| 7 | 58 | 1:2 | N | N | D | 1.89 | 3.57 |
| 8 | 58 | 1:2 | N | N | D | 1.89 | 3.62 |
| 9 | 58 | 1:2 | N | N | E | 1.38 | 1.76 |
| 10 | 58 | 1:2 | N | N | E | 1.40 | 1.70 |
| 11 | 58 | 1:2 | N | Y | B | 0.85 | 1.26 |
| 12 | 58 | 1:2 | N | Y | B | 0.78 | 1.28 |
| 13 | 58 | 1:2 | Y | N | B | 0.92 | 1.29 |
| 14 | 58 | 1:2 | Y | N | B | 0.87 | 1.17 |

Notes
Water Rinse Rinse after microwave treatment and ash removal
Solvent Rinse Rinse after microwave treatment and ash removal
Ash removal:
A No ash removal
B one pass through non-adjustable commercial removal unit
C two passes through non-adjustable commercial removal unit
D three passes through non-adjustable commercial removal unit
E four passes through non-adjustable commercial removal unit

I claim:

1. A process for scouring wool comprising the steps of (a) treating the wool by irradiation with microwave energy so as to cause at least partial liquefaction of grease contaminants present in the wool;

(b) adding to the wool a material capable of absorbing liquefied grease contaminants in wool, wherein steps (a) and (b) can be carried out in any order;

(c) mixing the wool and the grease-absorbing material such that at least some of the liquefied grease contaminants absorb to the material; and (d) separating the grease-absorbing material from the wool.

2. The process according to claim 1 wherein the temperature of the wool fibres during the process for scouring is less than about 70° C.

3. The process according to claim 1 wherein the treating of the wool and the mixing of the wool with the grease-absorbing material are carried out in one vessel.

4. The process according to claim 1 wherein the grease-absorbing material is a particulate material.

5. The process according to claim 4 wherein the particulate material is diatomaceous earth.

6. The process according to claim 1 wherein the wool is obtained from sheep.

7. The process according to claim 1 wherein when step (a) occurs after step (b), the treating step (a) provides differential heating such that the grease contaminants are heated while the wool fibers and the grease-absorbing material are substantially unheated or heated less than the grease contaminants.

8. The process according to claim 7 wherein the temperature of the wool fibers during the process for scouring is less than about 70° C.

9. The process according to claim 7 wherein the treating of the wool and the mixing of the wool with the grease-absorbing material are carried out in one vessel.

10. The process according to claim 7 wherein the grease-absorbing material is a particulate material.

11. The process according to claim 10 wherein the particulate material is diatomaceous earth.

12. The process according to claim 7 wherein the wool is obtained from sheep.

13. An apparatus for scouring wool comprising:

(a) a treating means for generating microwave energy to cause at least partial liquefaction of grease contaminants present in the wool;

(b) a vessel adapted to receive wool and a material capable of absorbing liquefied grease contaminants present in wool;

(c) means for mixing the wool and grease-absorbing material in the vessel; and (d) means for separating the grease-absorbed material from the wool, wherein the treating means causes at least partial liquefaction of the grease contaminants when the wool is in the vessel, and the wool and the grease-absorbing material are mixed in the vessel by the mixing means such that liquefied-grease contaminants absorb to the material prior to separation.

14. The apparatus according to claim 13, wherein the mixing means is selected from the group consisting of a cyclone chamber, a rotary drum, and an auger.

* * * * *

UNITED STATES PATENT AND TRADEMARK OFFICE

CERTIFICATE OF CORRECTION

PATENT NO. : 5,954,841

DATED : September 21, 1999

INVENTOR(S) : Beven, Peter William

It is certified that error appears in the above-identified patent and that said Letters Patent is hereby corrected as shown below:

Title Page, Item [73], delete "Primary Applications Limited, Goulbourn NSE, Australia", and insert -- Primary Applications Pty. Limited, Moree, New South Wales, Australia --

Signed and Sealed this

Eighth Day of August, 2000

*Attest:*

*Attesting Officer*

Q. TODD DICKINSON

*Director of Patents and Trademarks*